US008919826B2

(12) United States Patent
Small et al.

(10) Patent No.: US 8,919,826 B2
(45) Date of Patent: Dec. 30, 2014

(54) SCREEN FRAME GRASPING AND REMOVAL SYSTEM

(71) Applicant: Screenco Manufacturing Ltd., Concord (CA)

(72) Inventors: Jennifer Small, Concord (CA); Alfred MacLean, Kettleby (CA)

(73) Assignee: Screenco Manufacturing Ltd., Concord (CA)

( * ) Notice: Subject to any disclaimer, the term of this patent is extended or adjusted under 35 U.S.C. 154(b) by 0 days.

(21) Appl. No.: 13/772,951

(22) Filed: Feb. 21, 2013

(65) Prior Publication Data

US 2014/0001773 A1 Jan. 2, 2014

(30) Foreign Application Priority Data

Jun. 29, 2012 (CA) ..... 2782425

(51) Int. Cl.
*E05C 1/10* (2006.01)
*E05C 1/00* (2006.01)
*E06B 9/00* (2006.01)

(52) U.S. Cl.
CPC . *E05C 1/004* (2013.01); *E05C 1/10* (2013.01); *E06B 9/00* (2013.01); *Y10S 292/70* (2013.01); *Y10S 292/63* (2013.01); *Y10S 292/47* (2013.01)
USPC ..... 292/175; 292/DIG. 70; 292/DIG. 63; 292/DIG. 47

(58) Field of Classification Search
USPC ..... 292/175, DIG. 70, DIG. 63, DIG. 47, 292/DIG. 35, DIG. 20
See application file for complete search history.

(56) References Cited

U.S. PATENT DOCUMENTS 1,765,388 A * 6/1930 Watson ..... 160/369
4,311,183 A * 1/1982 Herbst et al. ..... 160/37
5,431,211 A * 7/1995 Guillemet ..... 160/381

* cited by examiner

*Primary Examiner* — Mark Williams
(74) *Attorney, Agent, or Firm* — Advitam IP, LLC

(57) ABSTRACT

In one embodiment the present invention is a screen frame grasping and removal system comprising at least one pull tab. There is at least one lock to lock each tab. The frame defines openings to receive the tab and lock cooperation, the tab and lock openings communicating with each other to permit the lock to engage the tab. In another embodiment the above includes one side of the frame defining an opening to receive the tab and an opening to receive the lock, the tab and lock openings communicating with each other to permit the lock to engage the tab; and a second side of the frame contains therein at least one outwardly springing bias. The screen first and second side opposing each other.

6 Claims, 5 Drawing Sheets

SCREEN FRAME GRASPING AND REMOVAL SYSTEM

FIELD OF THE INVENTION

This invention relates to screens generally for windows, and more specifically to a system for installing and removing screens.

BACKGROUND

Numerous window and window frame types are available on the market. Screens either install on a building inside or outside (the building defining an opening for a window and screen between the inside and outside), and appear either in front of (meaning disposed toward the building inside) or behind (meaning disposed toward the building outside) the window. There are different window types depending on the frame, including slider, double, and single hung windows. Any screen appearing behind a window typically requires installation from outside the building. Prior art screen systems permit installation and removal from inside the building, but require pivoting metal clips. These clips can easily fall out of their guide slots, be lost, and are cumbersome to operate. The clips also have pointy ends, posing a safety hazard.

SUMMARY OF THE INVENTION

In one embodiment the present invention is a screen frame grasping and removal system comprising at least one pull tab. There is at least one lock to lock each tab. The frame defines openings to receive the tab and lock cooperation, the tab and lock openings communicating with each other to permit the lock to engage the tab.

In another embodiment the present invention is a screen frame grasping and removal system comprising at least pull tab. There is at least one lock to lock each tab. One side of the frame defines an opening to receive the tab and an opening to receive the lock, the tab and lock openings communicating with each other to permit the lock to engage the tab. A second side of the frame contains therein at least one outwardly springing bias. The screen first and second side opposing each other.

DRAWINGS

DETAILED DESCRIPTION OF THE DRAWING

Figure 5:
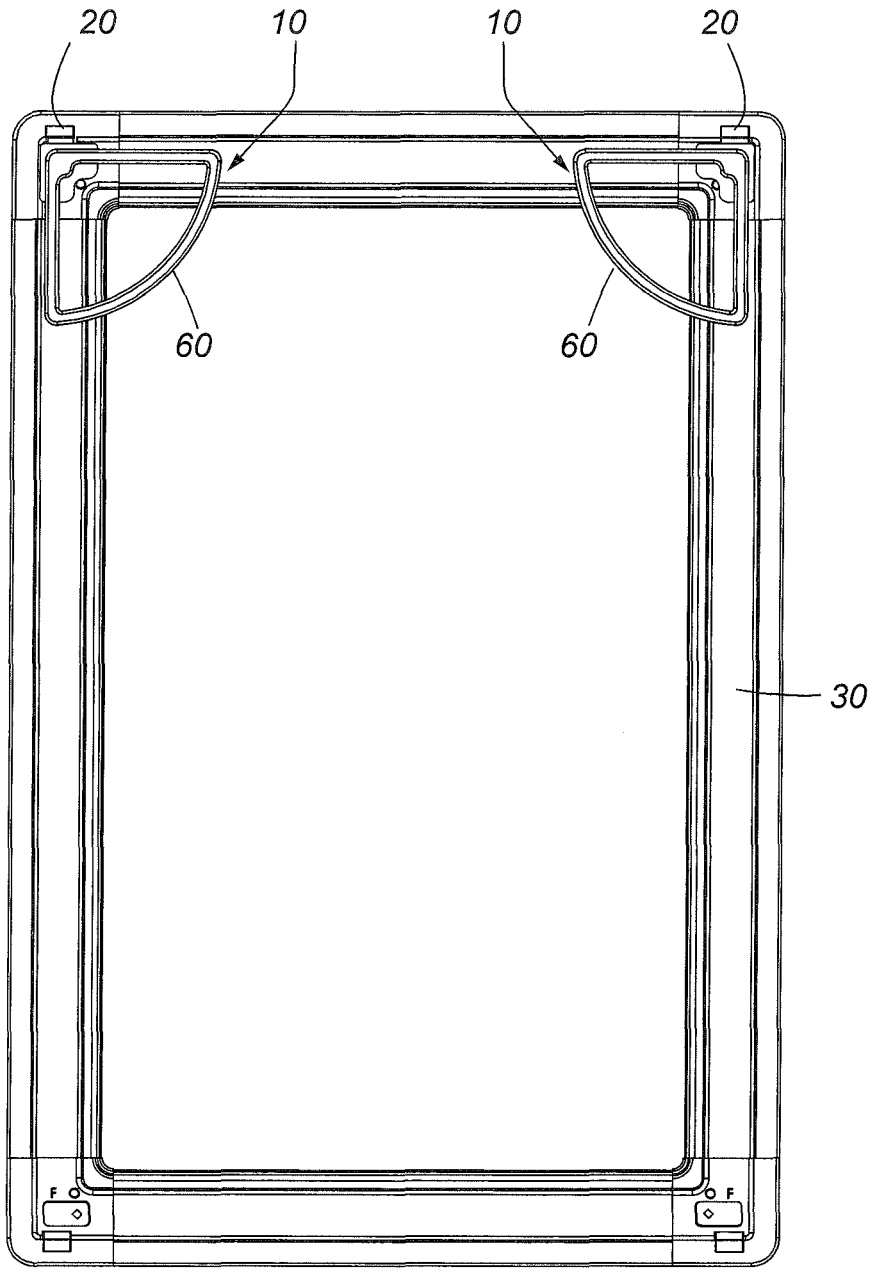
FIG. 5 is a plan view of a screen with a pull tab and locking pin system, and a spring loaded wedge system.

A screen frame grasping and removal system shown in FIG. 5 comprises at least one pull tab (10). There is also at least one lock to lock each tab (10) (one per tab (20)). The frame (30) defines tab and lock openings (40, 50) to receive the tab and lock (10, 20) cooperation, the tab and lock openings (40, 50) communicating with each other to permit the lock (20) to engage the tab (10).

Figure 1:
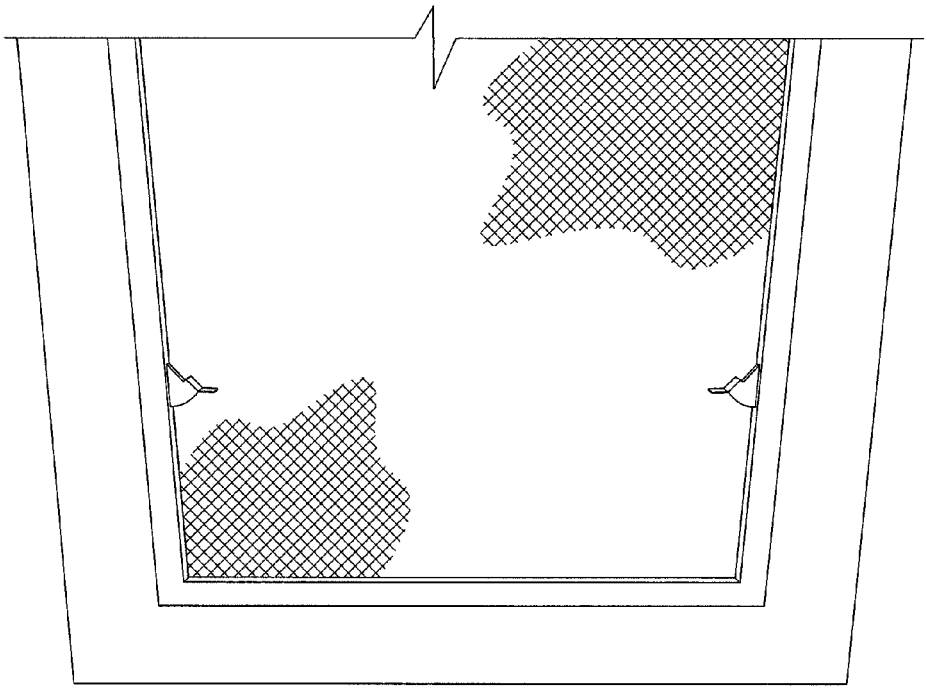
PRIOR ART FIG. 1
FIG. 1 is a prior art window screen showing pivoting metal clips.
Figure 2:
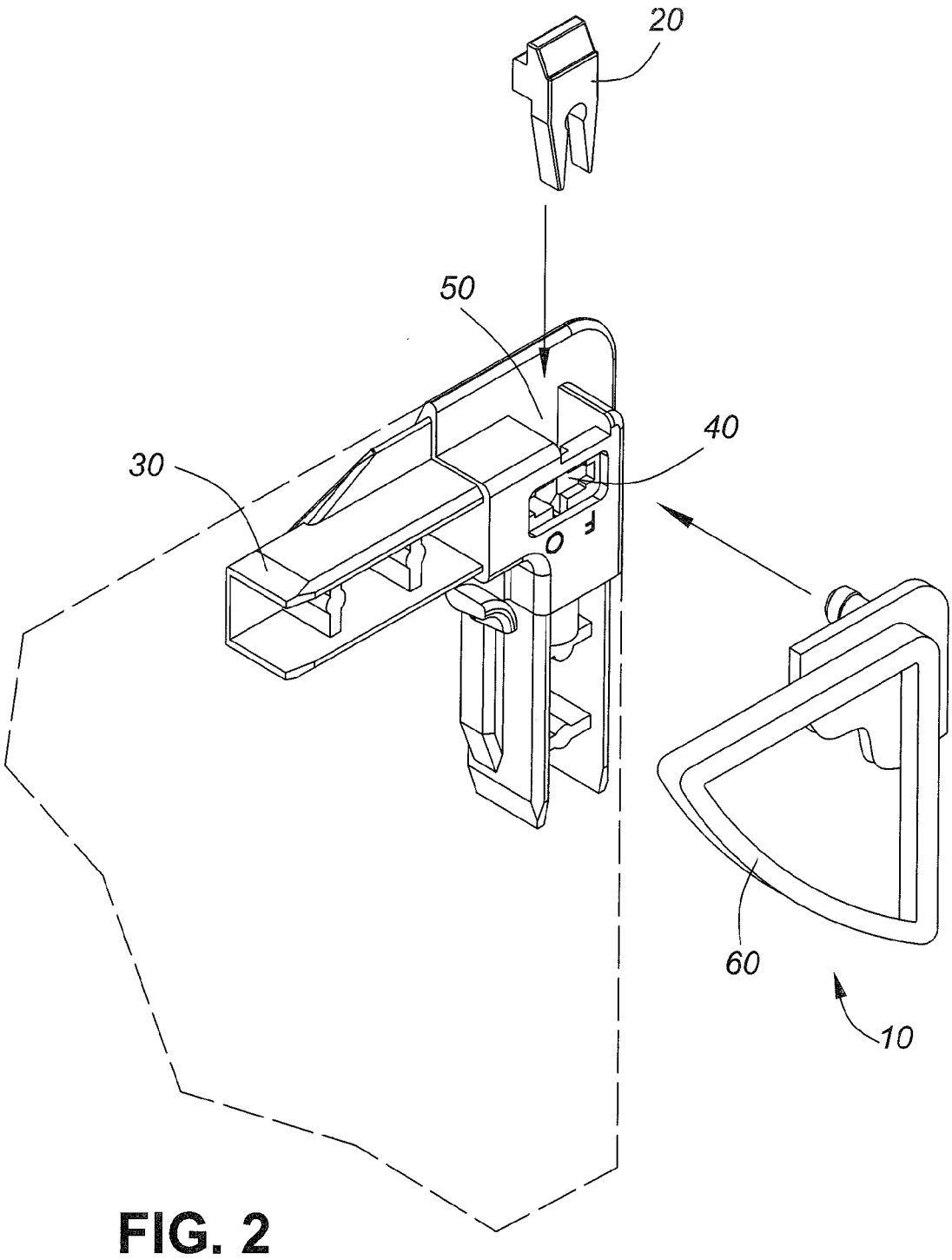
FIG. 2 is an exploded perspective view of a pull tab and locking pin system.

Most frames (30) are quadrilateral (like FIGS. 1, 4 and 5), but depending on engineering, the system could be applied to screens for unusual shaped windows (like oval). The lock and tab openings (40, 50) are adjacent a corner of the quadrilateral, in the configuration shown (FIG. 5).

The tab (10) comprises a handle (60), to grasp and pull on, and a pin (70) to project inward the tab opening (40). User fingers can pass through the tab (10) shown in FIG. 5, but other variants are possible such as a tongue (solid, no openings; not shown).

Figure 3:
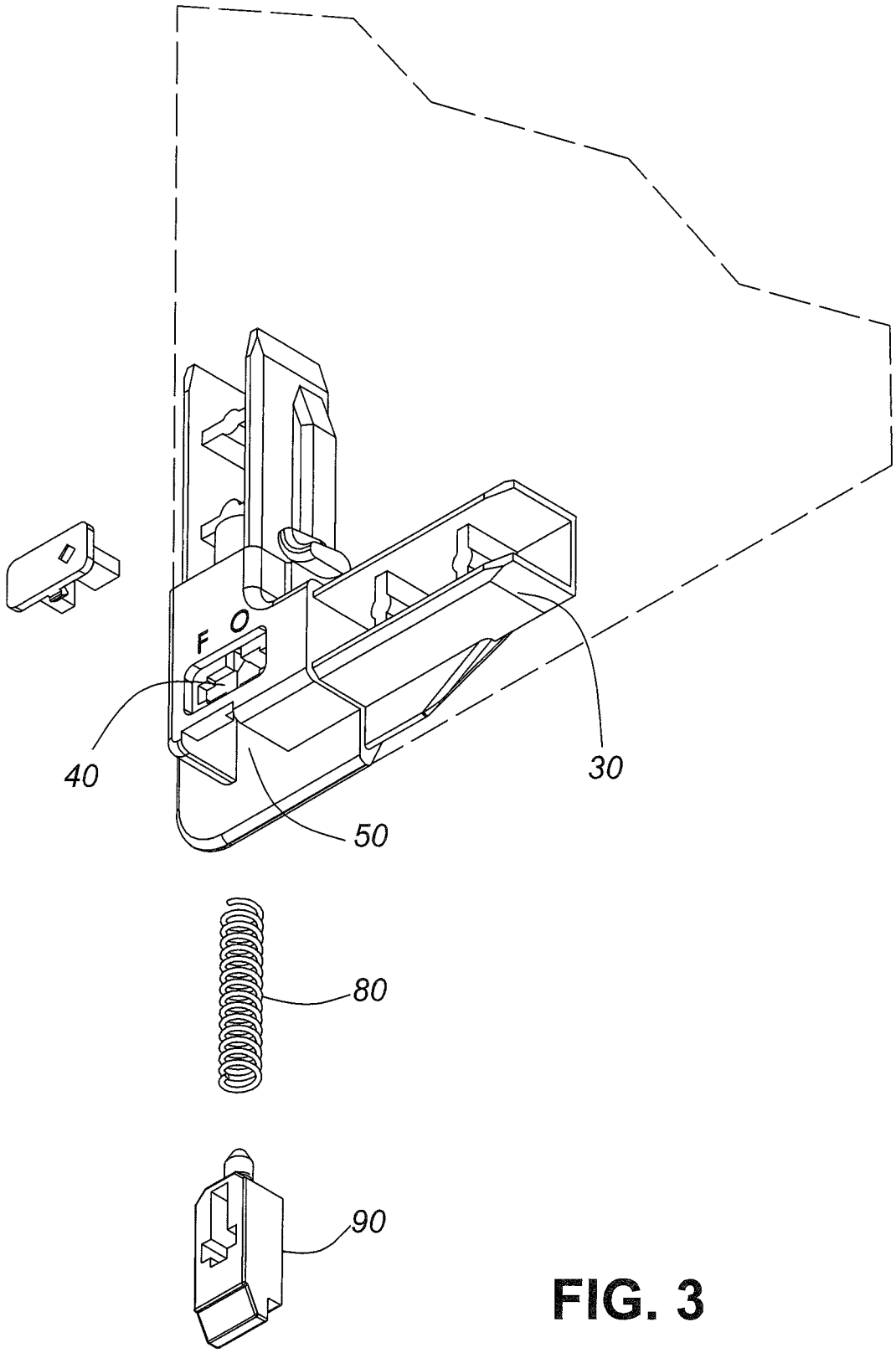
FIG. 3 is an exploded perspective view of spring loaded wedge system.
Figure 4:
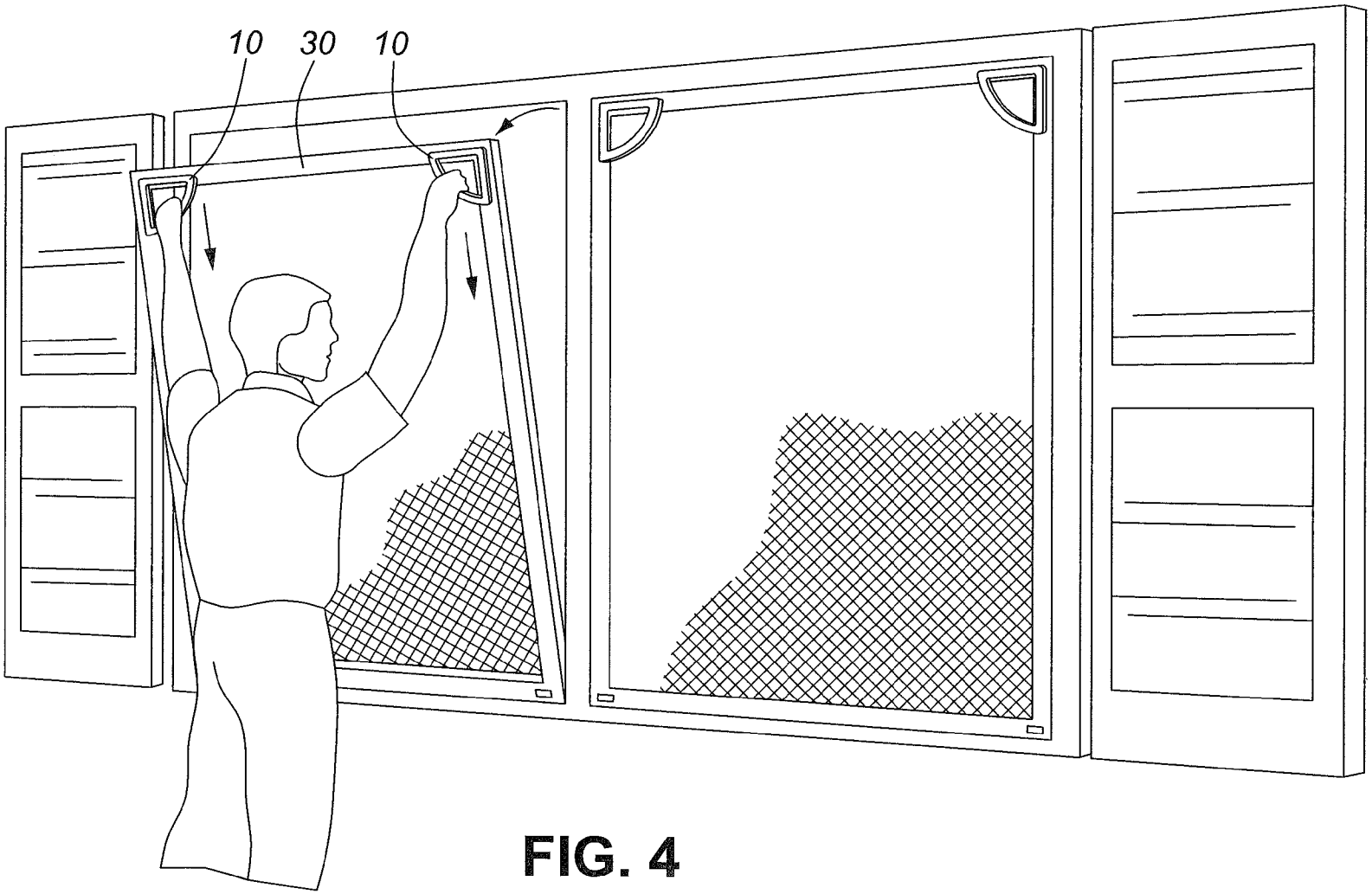
FIG. 4 is a perspective of a screen installation using a pull tab and locking pin system with opposing spring loaded wedges.

The tab (10) and lock (20) are, in FIG. 5, disposed toward one side of the frame. A second side of the frame can also be configured to have at least one outwardly springing bias, like in FIG. 3. In FIG. 3 specifically, the bias is in the form of a coiled spring (80) exerting against a wedge (90). The wedge (90) slides into grooves within window frames (not shown), to stabilize and support the screen frame. In FIG. 4, the first side opposes the second side, such that a user could pull "down" on the tabs (10) near the frame "top", resulting in spring (80) and wedge (90) compression at the "bottom". Such action permits either of installation or removal from the window frame.

What is claimed is:

1. A screen frame grasping and removal system comprising:

at least one pull tab, the at least one pull tab situated in an upper portion of the screen frame, the at least one pull tab is configured such that when the screen frame is in an installed position within a window opening, the at least one pull tab allows for grasping and downward pulling of the screen frame against an upward bias of the screen frame within the window opening, for releasing the upper portion of the screen frame from the window opening and allowing for removal of the screen frame from the installed position;

at least one lock to lock each at least one pull tab into the screen frame; and wherein the screen frame defines at least one openings to receive each at least one lock of each at least one pull tab, thereby engaging lock, screen frame and pull tab together as a single unit.

2. The system in claim 1 wherein the screen frame is a quadrilateral.

3. The system in claim 1 wherein the lock and tab openings are adjacent a corner of the quadrilateral.

4. The system in claim 1 wherein the pull tab defines an opening, to pass fingers therethrough.

5. A screen frame grasping and removal system comprising:

at least one pull tab, the at least one pull tab situated in an upper portion of the screen frame, the at least one pull tab is configured such that when the screen frame is in an installed position within a window opening, the at least one pull tab allows for grasping and downward pulling of the screen frame against an upward bias of the screen frame within the window opening for releasing the upper portion of the screen frame from the window opening and allowing for removal of the screen frame from the installed position;

at least one lock to lock each at least one pull tab into the screen frame;

wherein the screen frame upper portion defines at least one opening to receive each at least one lock of each at least one pull tab, thereby engaging the lock, screen frame and pull tab together as a single unit;

at least one outwardly and downwardly springing bias situated in a lower portion of the screen frame, for locking and stabilizing the screen frame within a window opening when in an extended position, and for retraction into the screen frame upon a downward pulling of the at least one pull tab when the screen frame is within the window opening; and the screen frame upper and lower portions opposing each other to permit up and down movement of the screen frame within the window opening when the at least one tab is released and pulled downward respectively and the at least one bias is extended and retracted respectively.

6. The system in claim 5 wherein the tab defines an opening, to pass fingers therethrough.

* * * * *